US007928151B2

(12) United States Patent
Oniyanagi et al.

(10) Patent No.: US 7,928,151 B2
(45) Date of Patent: Apr. 19, 2011

(54) RESIN COMPOSITION FOR SHELL MOLD AND RESIN COATED SAND

(75) Inventors: Daiki Oniyanagi, Ibaraki (JP); Masaru Wada, Ibaraki (JP); Yoshirou Oowada, Ibaraki (JP); Tetsurou Saikawa, Ibaraki (JP)

(73) Assignee: Hitachi Chemical Company, Ltd., Tokyo (JP)

( * ) Notice: Subject to any disclaimer, the term of this patent is extended or adjusted under 35 U.S.C. 154(b) by 63 days.

(21) Appl. No.: 12/282,375

(22) PCT Filed: Dec. 11, 2006

(86) PCT No.: PCT/JP2006/324687

§ 371 (c)(1), (2), (4) Date: Sep. 10, 2008

(87) PCT Pub. No.: WO2007/105347

PCT Pub. Date: Sep. 20, 2007

(65) Prior Publication Data

US 2009/0093567 A1 Apr. 9, 2009

(30) Foreign Application Priority Data

Mar. 14, 2006 (JP) ..... 2006-069005
Nov. 6, 2006 (JP) ..... 2006-300565

(51) Int. Cl.
*B22C 1/22* (2006.01)

(52) U.S. Cl. ..... 523/145; 523/146; 523/147; 523/209; 524/127; 524/140; 524/141

(58) Field of Classification Search ..... 523/145–147, 523/209; 524/127, 140, 141
See application file for complete search history.

(56) References Cited

U.S. PATENT DOCUMENTS

| | | | | |
|---|---|---|---|---|
| 4,157,993 | A * | 6/1979 | Funabiki et al. | 523/145 |
| 4,345,003 | A * | 8/1982 | Matsushima et al. | 523/145 |
| 2004/0009428 | A1 * | 1/2004 | Tamura et al. | 430/280.1 |
| 2007/0004872 | A1 * | 1/2007 | Lu et al. | 525/396 |
| 2007/0060674 | A1 * | 3/2007 | Wakizaka et al. | 523/451 |

FOREIGN PATENT DOCUMENTS

| | | | |
|---|---|---|---|
| JP | 58-003745 | | 1/1983 |
| JP | 63177938 | * | 7/1988 |
| JP | 64-078652 | | 3/1989 |
| JP | 05-237587 | | 9/1993 |
| JP | 08-057574 | | 3/1996 |

* cited by examiner

*Primary Examiner* — Peter Szekely
(74) *Attorney, Agent, or Firm* — Antonelli, Terry, Stout & Kraus, LLP.

(57) ABSTRACT

A resin composition for a shell mold which reduces smoke generation upon molding of a casting mold and maintains a crumbility and a casting mold strength of a phenolic resin, and resin coated sand by the use thereof are provided. The resin composition for the shell mold includes the phenolic resin and an aromatic condensed phosphate ester. The phenolic resin is used as a binder of the resin coated sand used for producing a main mold and a core for shell mold casting of cast iron, cast steel, aluminum, and the like. The aromatic condensed phosphate ester is very effective as a crumbling agent for improving the crumbility of the casting mold after casting.

18 Claims, No Drawings

RESIN COMPOSITION FOR SHELL MOLD AND RESIN COATED SAND

TECHNICAL FIELD

The present invention relates to a resin composition for a shell mold and resin coated sand (hereinafter referred to as RCS), which are useful for producing a casting mold of a casting. More particularly, the present invention relates to a resin composition for a shell mold and resin coated sand, which reduce smoke generation upon molding the casting mold, and have a good crumbility after casting and also maintain a casting mold strength in the production of aluminium casting having a low pouring temperature.

BACKGROUND ART

A wide variety of methods for manufacturing resin coated sand for a shell mold is available, and in general, a hot marling method is employed in terms of productivity and quality, i.e., the resin coated sand is manufactured by melting heated new sand or recycled sand and a phenolic resin followed by adding an aqueous solution of hexamethylenetetramine which is a curing agent. The resulting RCS is injected into a predetermined die assembly, and used as the casting mold by curing the phenolic resin.

By the way, aluminium parts have been often used recently for the purpose of lightening the parts related to automobiles, and increased castings of aluminium alloys having a low pouring temperature (about 700° C.) have been produced. When the casting is produced using the aluminium alloy having a low melting temperature, it becomes difficult to decompose and deteriorate the resin, and the casting mold itself does not crumble and remains in the casting after solidifying the metal in the conventional casting mold using the phenolic resin.

As measures for this, a method of treating again the casting with heat after casting in a high temperature furnace to remove the remaining casting mold, and a method of giving a physical impact to the casting to remove the casting mold are available. However, both the methods require considerable energy, and a secondary load is given to a casting product, which are problematic. As the method for improving them, for example, the method of using phosphate esters as a crumbling agent (see patent Document 1) is proposed.

Patent Document 1: Japanese Patent Application Laid-Open No. 58-3745

DISCLOSURE OF INVENTION

Problem to be Solved by the Invention

Also, there is a problem in that when the casting having the low pouring temperature is produced as described above, phosphate ester contained in a binder of the phenol resin generated from the casting mold is evaporated and vaporized, thereby generating smokes including tar and soot, which are not preferable in terms of working environment. However, it is an actual circumstance that a resin composition for a shell mold which reduces the smoke generation upon molding, has a good crumbility after casting and maintains a casting mold strength is not obtained yet. Therefore, the resin composition for the shell mold which reduces the smoke generation upon molding and contains a crumbling agent, and resin coated sand using this resin composition have been required.

It is an object of the present invention to provide the resin composition for the shell mold which reduces the smoke generation upon molding the casting mold and maintains the crumbility of the phenolic resin and the casting mold strength, and the resin coated sand by the use thereof.

Means for Solving Problem

For solving the problems described above and accomplishing the object, the resin composition for the shell mold according to the present invention includes a phenolic resin and an aromatic condensed phosphate ester.

The resin composition for the shell mold according to the present invention includes 3 to 30 parts by weight of the aromatic condensed phosphate ester relative to 100 parts by weight of the phenolic resin.

In the resin composition for the shell mold according to the present invention, the phenolic resin includes a novolak type phenolic resin and a resol type phenolic resin.

The resin composition for the shell mold according to the present invention includes more than 0 and 100 parts by weight or less of the novolak type phenolic resin relative to 100 parts by weight of the resol type phenolic resin.

In the resin composition for the shell mold according to the present invention, the aromatic condensed phosphate ester is a compound represented by the following formula (I):

[Chemical formula 1]

(I)

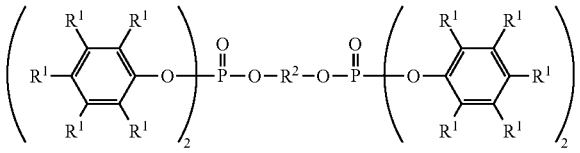

wherein, $R^1$ represents a hydrogen atom or an alkyl group having 1 to 8 carbon atoms, all $R^1$ may be the same or different, and $R^2$ represents an organic group having a bivalent aromatic group and having 6 to 20 carbon atoms.

The resin composition for the shell mold according to the present invention further includes a lubricant.

The resin composition for the shell mold according to the present invention further includes a silane coupling agent.

The resin coated sand according to the present invention is obtained by using the resin composition for the shell mold.

EFFECT OF THE INVENTION

According to the present invention, by using the aromatic condensed phosphate ester compound as the crumbling agent, it is possible to provide the resin composition for the shell mold which can maintain the properties such as crumbility, bending strength and stick point, reduce the smoke generation upon molding of the casting mold and maintain the casting mold strength, and the resin coated sand by the use thereof.

BEST MODES FOR CARRYING OUT THE INVENTION

[Resin Composition for Shell Mold]

The resin composition for the shell mold according to the present invention includes a phenolic resin and an aromatic condensed phosphate ester.

(Phenolic Resin)

The phenolic resin in the resin composition for the shell mold according to the present invention is used as a binder of RCS used for producing an main mold and a core (hereinafter, referred to as the casting mold) for shell mold casting of cast iron, cast steel, aluminum, and the like. Among materials for producing the phenolic resin, for example, phenol, cresol, xylenol and catechol are used as phenols, and paraformaldehyde and formalin are used as aldehydes.

The phenolic resin may include novolak type phenolic resins, resol type phenolic resins, and mixture and molten products thereof. The novolak type phenolic resin may include the novolak type resins obtained when synthesized by making a molar ratio of aldehydes to phenols (aldehydes/phenols, the same applies below) less than 1 and using an acid catalyst, and high ortho type novolak type resins using a metal acetate catalyst, and alkyl-modified phenolic resins.

As the resol type phenolic resin, it is possible to use the resol type phenolic resins obtained by making the aldehydes/phenols molar ratio 1 or more and using hydroxide of an alkali metal or an alkali earth metal as the catalyst, and the resol type phenolic resins obtained by using hydroxide of the alkali metal or the alkali earth metal as the catalyst and blending with ammonia or amines.

It is also possible to produce the RCS by blending the novolak type phenolic resin and the resol type phenolic resin. A mixed molten product of the novolak type phenolic resin and the resol type phenolic resin can also be used as the phenolic resin. When the novolak type phenolic resin and the resol type phenolic resin are blended or mixed molten to use, the ratio of both is not particularly limited, and an amount of the novolak type phenolic resin to be blended is preferably more than 0 and 100 parts by weight or less and more preferably 40 to 70 parts by weight relative to 100 parts by weight of the resol type phenolic resin. When the amount of the novolak type phenolic resin is more than 100 parts by weight, a curing speed tends to become slow.

(Aromatic Condensed Phosphate Ester)

The resin composition for the shell mold according to the present invention includes the aromatic condensed phosphate ester. This aromatic condensed phosphate ester is very effective as the crumbling agent which improves the crumbility of the casting mold after the casting. The amount of aromatic condensed phosphate ester to be blended is preferably 3 to 30 parts by weight and more preferably 8 to 15 parts by weight relative to 100 parts by weight of the phenolic resin. When the amount of the aromatic condensed phosphate ester is less than 3 parts by weight, an effect on the crumbility becomes small. Meanwhile, when the amount of the aromatic condensed phosphate ester to be blended exceeds 30 parts by weight, a softening point of the resin is remarkably reduced, and when the RCS is produced, the stick point is reduced to cause a blocking as well as the casting mold strength is reduced and the curing speed tends to become slow.

As the aromatic condensed phosphate ester in the present invention, for example, it is possible to use the compound represented by the following formula (I):

[Chemical formula 1]

(I)

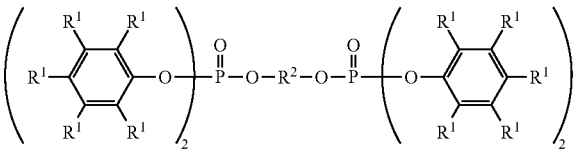

wherein, $R^1$ represents a hydrogen atom or an alkyl group having 1 to 8 carbon atoms, all $R^1$ may be the same or different, and $R^2$ represents an organic group having a bivalent aromatic group and having 6 to 20 carbon atoms.

Here, $R^1$ represents the hydrogen atom or the alkyl group having 1 to 8 carbon atoms, all $R^1$ may be the same or different, and the hydrogen atoms and the alkyl groups having 1 to 8 carbon atoms may be mixed. The alkyl groups having different numbers of carbon atoms may also be mixed. Preferable $R^1$ are composed of the hydrogen atom and methyl group. More preferable $R^1$ is the compound where 0 to 2 methyl groups have substituted per one phenyl group in the above formula (I).

$R^2$ represents the organic group having the bivalent aromatic group and having 6 to 20 carbon atoms. The organic group having the bivalent aromatic group may be an organic group having an aromatic group such as substituted or unsubstituted phenylene group, biphenylene group or naphthylene group in a main chain skeleton. $R^2$ may also include a halogen atom such as chlorine and bromine atoms. Preferable $R^2$ includes biphenyl alkylene group and phenylene group as represented by the following formula (II).

[Chemical formula 2]

(II)

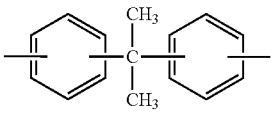

More specifically, the aromatic condensed phosphate ester may include CR-741 (mainly composed of α-diphenoxyphosphoryl-ω-phenoxypoly (n=1 to 3)[oxy-1,4-phenyleneisopropylidene-1,4-phenyleneoxy(phenoxyphosphoryl)]), CR-733S (phenylenebis(phenylcresolphosphate)), CR-747 (2,2-bis{4-[bis((mono- or di-) methylphenoxy)phosphoryloxy]phenyl}propane,PX-200 (1,3-phenylenebis(dixylenyl) phosphate) (all are brand names supplied from Daihachi Chemical Industry Co., Ltd.) used alone or in mixture or mixed molten product of two or more.

The aromatic condensed phosphate ester according to the present invention exhibits a good crumbility effect in 100% new sand or 100% recycled sand or a mixed system of the new sand and the recycled sand, in the selection of the sand which is a refractory granular material when the RCS is produced.

(Other Additive Components)

In the phenolic resin used in the present invention, a lubricant, a silane coupling agent, and the like commonly used in the art may be added as needed within the range in which the essential effects of the present invention are not inhibited. The lubricant is preferable because it enhances the casting mold strength and anti-blocking property. As the lubricant, it is possible to use ethylenebisstearic acid amide, ethylenebisoleic acid amide, methylenebisstearic acid amide, oxystearic acid amide, stearic acid amide, palmitic acid amide, oleic acid amide, methylolamide, calcium stearate, polyethylene wax, paraffin wax, montan wax, carnauba wax, and the like.

The amount of the lubricant to be added is desirably 0.3 to 5 parts by weight relative to 100 parts by weight of the phenolic resin. When the amount is less than 0.3 parts by weight, the effects on the strength enhancement and the anti-blocking property are small. The amount which exceeds 5 parts by weight is not preferable because the curing speed becomes slow and an adhesive force between sand particles is inhibited. The method for blending the lubricant is not particularly limited, and it is desirable to add at temperature of 150° C. or above. A time for mixing after the addition is not particularly limited, and it is preferable to mix for one hour or longer. The lubricant can also be added when a binder and the sand are kneaded to produce the RCS after producing the resin for the shell mold.

The silane coupling agent is typically added for increasing the adhesive force between the sand and the resin for the shell mold. The silane coupling agent capable of being blended in the resin composition for the shell mold according to the present invention is not particularly limited, and is preferably an aminosilane coupling agent. As the aminosilane coupling agent, N-β(aminoethyl)-γ-aminopropyl trimethoxysilane, N-β(aminoethyl)-γ-aminopropylmethyl dimethoxysilane, γ-aminopropyl triethoxysilane, and the like are used. The amount of the silane coupling agent to be blended is not particularly limited and is desirably 0.05 to 5 parts by weight relative to 100 parts by weight of the phenolic resin. When the amount is less than 0.05 parts by weight, an effect of the strength enhancement by the silane coupling agent is low. The amount which exceeds 5 parts by weight is not preferable because a risk of blocking occurs in the phenolic resin.

[Resin Coated Sand (RCS)]

The resin coated sand according to the present invention is produced from the refractory granular material which is an aggregate for the casting mold and the above resin composition for the shell mold. Here, the refractory granular material may include silica sand mainly composed of quartzose, chromite sand, zircon sand, olivine sand, mullite sand, synthetic mullite sand, magnesia, and sands collected therefrom and sands recycled therefrom. In the present invention, the sand is not particularly limited to the new sand, the collected sand, the recycled sand or mixed sands thereof, and various refractory granular materials can be used. A grain fineness distribution and a particle diameter of the refractory granular material can be selected without being particularly limited as long as it has a refractoriness capable of withstanding the casting and is suitable for forming the casting mold.

The RCS can be produced by placing the refractory granular material heated at a predetermined temperature in, for example, a mixer, and melting/coating the aforementioned resin composition for the shell mold to the refractory granular material, followed by kneading them. As one example, the refractory granular material is heated to 130 to 160° C., the heated refractory granular material and the above resin composition for the shell mold are kneaded, subsequently an aqueous solution containing hexamethylenetetramine as the curing agent is added, and the resulting mixture is kneaded until masses of the refractory granular material are broken down. Further, calcium stearate as the lubricant is added and dispersed to yield the RCS.

The present invention will be described more specifically below based on Examples. The present invention is not limited to the following Examples.

EXAMPLES

Example 1

In a four-necked flask equipped with a stirrer, a reflux condenser and a thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in an oil bath with stirring and reacted at reflux temperature until the reaction solution was emulsified. Subsequently, the reaction solution was concentrated under reduced pressure, an end point was set when a softening point was 90° C., and then 109.5 g of an aromatic condensed phosphate ester (brand name: CR-741 supplied from Daihachi Chemical Industry Co., Ltd.) composed mainly of α-diphenoxyphosphoryl-ω-phenoxypoly (n=1 to 3)[oxy-1,4-phenyleneisopropylidene-1,4-phenyleneoxy(phenoxyphosphoryl)] was added thereto to yield 882 g of a novolak type phenolic resin.

Example 2

826 g Of a novolak type phenolic resin was yielded in the same way as in Example 1 except that an amount of the aromatic condensed phosphate ester (brand name: CR-741 supplied from Daihachi Chemical Industry Co., Ltd.) in Example 1 was 27.4 g.

Example 3

996 g of a novolak type phenolic resin was yielded in the same way as in Example 1 except that the amount of the aromatic condensed phosphate ester (brand name: CR-741 supplied from Daihachi Chemical Industry Co., Ltd.) in Example 1 was 274 g.

Example 4

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, the end point was set when the softening point was 90° C., and then 109.5 g of phenylenebis (phenylcresolphosphate) (brand name: CR-733 supplied from Daihachi Chemical Industry Co., Ltd.) which is an aromatic condensed phosphate ester was added thereto to yield 882 g of a novolak type phenolic resin.

Example 5

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, the end point was set when the softening point was 90° C., and then 109.5 g of (2,2-bis{4-[bis((mono- or di-)methylphenoxy)phosphoryloxy]phenyl}propane(brand name: CR-747 supplied from Daihachi Chemical Industry Co., Ltd.) which is an aromatic condensed phosphate ester was added thereto to yield 882 g of a novolak type phenolic resin.

Example 6

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, the end point was set when the softening point was 90° C., and then 109.5 g of 1,3-phenylenebis (dixylenyl)phosphate (brand name: PX-200 supplied from Daihachi Chemical Industry Co., Ltd.) which is an aromatic condensed phosphate ester was added thereto to yield 882 g of a novolak type phenolic resin.

Comparative Example 1

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, the end point was set when the softening point was 90° C., and then 109.5 g of triphenyl phosphate (brand name: TPP supplied from Daihachi Chemical Industry Co., Ltd.) which is a phosphate ester was added thereto to yield 882 g of a novolak type phenolic resin.

Comparative Example 2

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, the end point was set when the softening point was 90° C., and then 109.5 g of dibutylhydroxymethyl phosphate (brand name: CR-707 supplied from Daihachi Chemical Industry Co., Ltd.) which is a phosphate ester was added thereto to yield 882 g of a novolak type phenolic resin.

Comparative Example 3

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, the end point was set when the softening point was 90° C., and then 109.5 g of 2-ethylhexyldiphenyl phosphate (brand name: #41 supplied from Daihachi Chemical Industry Co., Ltd.) which is a phosphate ester was added thereto to yield 882 g of a novolak type phenolic resin.

Comparative Example 4

In a four-necked flask equipped with the stirrer, the reflux condenser and the thermometer, 873 g of phenol (supplied from Mitsui Chemicals Inc.), 125 g of 92% paraform (supplied from Formol Inc.), 171 g of 37% formalin (supplied from Nippon Kasei Chemical Co., Ltd.) and 0.55 g of oxalic acid (supplied from Mitsubishi Gas Chemical Company Inc.) were blended, heated in the oil bath with stirring and reacted at reflux temperature until the reaction solution was emulsified. Subsequently, the reaction solution was concentrated under reduced pressure, and the end point was set when the softening point was 90° C. to yield 773 g of a novolak type phenolic resin.

(Production of Resin Coated Sand [RCS])

150 g of each novolak type phenolic resin obtained in the above Examples 1 to 6 and Comparative Examples 1 to 4 was kneaded with 10 kg of new sand (natural sand produced in Australia, brand name: Free Mantle) heated at 150° C. for 45 seconds using a speed mixer, subsequently, 142 g of an aqueous solution of 15% hexamethylenetetramine (supplied from ChangChun Plastics Co., Ltd.) and the resulting mixture was kneaded until the sand fell apart. Further, 10 g of calcium stearate (supplied from NOF Corporation) was added and the mixture was mixed for 20 seconds to yield RCS by discharging from the mixer.

The sand used in the resulting RCS was Free Mantle, and the amount of the added resin was 1.5% (relative to the weight of the sand). The properties of the RCS shown below were evaluated and measurement results were shown in Table 1.

The bending strength was measured in accordance with JIS K 6910 (phenolic resin test method). That is, a maximum bending stress when a test piece of the baked RCS was supported with its both ends and a concentrated load was given to its central part from an upper part was rendered the bending strength (kg/cm$^2$). The test piece was molded by baking at die temperature of 250° C. for 60 seconds.

The stick point was measured in accordance with JACT test method C-1 (stick point test method). That is, the RCS to be measured was quickly spread on a metal bar having a temperature gradient, and after 60 seconds, the RCS on the metal bar was blown out by moving a nozzle having a nozzle size of 1.0 mm driven along a guiding bar in the location 10 cm apart from the metal bar at an air pressure of 0.1 MPa from a low temperature region to a high temperature region reciprocally once. The temperature of a boundary line between the blown out RCS and the RCS which had not been blown out was read out by 1° C. increment to obtain the stick point (° C.).

The presence or absence of smoking was visually determined upon molding.

A crumble rate (crumbility) was calculated from the difference between the bending strength at ambient temperature and the bending strength after being treated with heat at 400° C. for 15 minutes (see the following formula).

Crumble rate={(Bending strength at ambient temperature [kg/cm$^2$])−(Bending strength after being treated at 400° C. for 15 minutes [kg/cm$^2$])}/((Bending strength at ambient temperature [kg/cm$^2$])×100 [Mathematical formula 1]

TABLE 1

| | | Item | Unit | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|---|---|---|
| Composition | | Phenolic resin | (Part by weight) | 100 | 100 | 100 | 100 | 100 | 100 | 100 | 100 | 100 | 100 |
| | Phosphate ester | Triphenyl phosphate | (Part by weight) | — | — | — | — | — | — | 12 | — | — | — |
| | | Dibutylhydroxy methyl phosphate | (Part by weight) | — | — | — | — | — | — | — | 12 | — | — |
| | | 2-Ethylhexyl diphenyl phosphate | (Part by weight) | — | — | — | — | — | — | — | — | 12 | — |
| | Aromatic condensed phosphate ester | α-Diphenoxyphosphoryl-ω-phenoxypoly (n = 1 to 3) [oxy-1,4-phenyleneisopropylidene-1,4-(phenoxyphosphoryl) (Major component) | (Part by weight) | 12 | 3 | 30 | — | — | — | — | — | — | — |
| | | Phenylenebis(phenyl cresolphosphate) | (Part by weight) | — | — | — | 12 | — | — | — | — | — | — |
| | | 2-2-Bis{4-[bis((mono- or di-)methylphenoxy) phosphoryloxy]phenyl} propane | (Part by weight) | — | — | — | — | 12 | — | — | — | — | — |
| | | 1,3-Phenylenebis-(dixylenyl)phosphate | (Part by weight) | — | — | — | — | — | 12 | — | — | — | — |
| | RCS property | Crumbility | (%) | 75 | 45 | 98 | 75 | 79 | 70 | 72 | 79 | 85 | 29 |
| | | Smoke generation | (–) | less | less | less | less | less | less | much | much | much | less |
| | | Bending strength | (kg/cm$^2$) | 61.4 | 71.9 | 49.5 | 58.3 | 60.0 | 62.5 | 58.7 | 62.1 | 60.1 | 75.0 |
| | | Stick point | (° C.) | 101 | 106 | 90 | 100 | 101 | 100 | 104 | 103 | 89 | 108 |

As is evident from the results in Table 1, by adding the aromatic condensed phosphate ester in Examples 1 to 6, it became possible to provide the resin composition for the shell mold which produced less smoking with similar other properties. On the contrary, much smoke was generated in Comparative Examples 1 to 3, and in Comparative Example 4, the crumbility was inferior although less smoke was generated. Thus, all of them had insufficient properties as the resin composition for the shell mold.

INDUSTRIAL APPLICABILITY

As described above, by using the aromatic condensed phosphate ester as the crumbling agent, the resin composition for the shell mode according to the present invention can maintain the properties such as crumbility, bending strength and stick point, reduce the smoke generation upon molding of the casting mold and maintain the casting mold intensity. Therefore, the resin composition for the shell mode according to the present invention is useful for the resin coated sand and in particular, suitable for producing the aluminium casting.

The invention claimed is:

1. A resin composition for a shell mold comprising a phenolic resin and an aromatic condensed phosphate ester, wherein the phenolic resin includes a blend of a novolak phenolic resin and a resol phenolic resin, and the aromatic condensed phosphate ester is selected from the group consisting of α-diphenoxyphosphoryl-ω-phenoxypoly (n=1 to 3) [oxy-1,4-phenyleneisopropylidene-1,4-phenyleneoxy(phenoxyphosphoryl)], phenylenebis (phenylcresolphosphate), 2,2-bis{4-[bis((mono- or di-) methylphenoxy)phosphoryloxy]phenyl}propane, 1,3phenylenebis (dixylenyl)phosphate, a compound represented by a following formula (I):

(I)

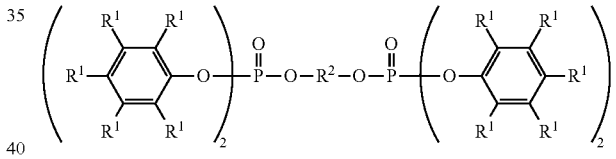

wherein $R^1$ represents a hydrogen atom or an alkyl group having 1 to 8 carbon atoms, all $R^1$ may be the same or different, and $R^2$ represents an organic group having a bivalent aromatic group and having 6 carbon atoms, and mixtures thereof.

2. The resin composition for the shell mold according to claim 1, wherein the resin composition comprises 3 to 30 parts by weight of the aromatic condensed phosphate ester relative to 100 parts by weight of the phenolic resin.

3. The resin composition for the shell mold according to claim 1, wherein the resin composition comprises more than 0 and 100 parts by weight or less of the novolak phenolic resin relative to 100 parts by weight of the resol phenolic resin.

4. The resin composition for the shell mold according to claim 1, further comprising a lubricant.

5. The resin composition for the shell mold according to claim 1, further comprising a silane coupling agent.

6. The resin composition for the shell mold according to claim 1, wherein the aromatic condensed phosphate ester is selected from the group consisting of α-diphenoxyphosphoryl-ω-phenoxypoly (n=1 to 3) [oxy-1,4-phenyleneisopropylidene-1,4-phenyleneoxy(phenoxyphosphoryl)], phenylenebis(phenylcresolphosphate), 2,2-bis{4-[bis((mono- or di-) methylphenoxy)phosphoryloxy]phenyl}propane and 1, 3phenylenebis (dixylenyl)phosphate and mixtures including at least one thereof.

7. The resin composition for the shell mold according to claim 1, wherein said bivalent aromatic group has an aromatic group which is a phenylene group in a main chain skeleton.

8. The resin composition for the shell mold according to claim 1, wherein the aromatic condensed phosphate ester includes said compound represented by said formula (I).

9. The resin composition for the shell mold according to claim 1, wherein the aromatic condensed phosphate ester is selected from the group consisting of phenylenebis(phenylcresol-phosphate) and 1, 3phenylenebis (dixylenyl)phosphate.

10. Resin coated sand obtained by using the resin composition for the shell mold comprising a phenolic resin and an aromatic condensed phosphate ester, wherein the aromatic condensed phosphate ester is selected from the group consisting of α-diphenoxyphosphoryl-ω-phenoxypoly (n=1 to 3) [oxy-1,4-phenyleneisopropylidene-1,4-phenyleneoxy(phenoxyphosphoryl)], phenylenebis(phenylcresolphosphate), 2,2-bis{4-[bis((mono- or di-)methylphenoxy)phosphoryloxy]phenyl}propane, 1, 3phenylenebis (dixylenyl)phosphate, a compound represented by a following formula (I):

(I)

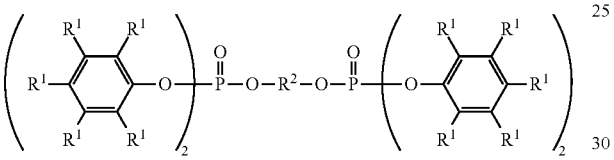

wherein $R^1$ represents a hydrogen atom or an alkyl group having 1 to 8 carbon atoms, all $R^1$ may be the same or different, and $R^2$ represents an organic group having a bivalent aromatic group and having 6 carbon atoms, and mixtures thereof.

11. The resin coated sand according to claim 10, wherein the aromatic condensed phosphate ester is selected from the group consisting of α-diphenoxyphosphoryl-ω-phenoxypoly (n=1 to 3) [oxy-1,4-phenyleneisopropylidene- 1,4-phenyleneoxy(phenoxyphosphoryl)], phenylenebis(phenylcresol-phosphate), 2,2-bis{4-[bis((mono- or di-)methylphenoxy) phosphoryloxy]phenyl}propane and 1, 3phenylenebis (dixylenyl)phosphate and mixtures including at least one thereof.

12. The resin coated sand according to claim 10, wherein the resin composition further comprises a lubricant.

13. The resin coated sand according to claim 10, wherein the resin composition further comprises a silane coupling agent.

14. A resin composition for a shell mold comprising a phenolic resin and an aromatic condensed phosphate ester, wherein the aromatic condensed phosphate ester is selected from the group consisting of α-diphenoxyphosphoryl-ω-phenoxypoly (n=1 to 3) [oxy-1,4-phenyleneisopropylidene-1,4-phenyleneoxy(phenoxyphosphoryl)], phenylenebis(phenylcresolphosphate), 2,2- bis{4-[bis((mono- or di-)methylphenoxy)phosphoryloxy]phenyl}propane and 1,3-phenylenebis (dixylenyl) phosphate and mixtures including at least one thereof.

15. The resin composition for the shell mold according to claim 14, wherein the resin composition comprises 3 to 30 parts by weight of the aromatic condensed phosphate ester relative to 100 parts by weight of the phenolic resin.

16. The resin composition for the shell mold according to claim 14, further comprising a lubricant.

17. The resin composition for the shell mold according to claim 14, further comprising a silane coupling agent.

18. The resin composition for the shell mold according to claim 14, wherein the aromatic condensed phosphate ester is selected from the group consisting of phenylenebis(phenylcresol-phosphate) and 1,3phenylenebis (dixylenyl)phosphate.

* * * * *